US008928560B2

(12) United States Patent
Pickett et al.

(10) Patent No.: US 8,928,560 B2
(45) Date of Patent: Jan. 6, 2015

(54) DISPLAY MATRIX WITH RESISTANCE SWITCHES

(75) Inventors: Matthew D. Pickett, San Francisco, CA (US); R. Stanley Williams, Portola Valley, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 255 days.

(21) Appl. No.: 13/424,776

(22) Filed: Mar. 20, 2012

(65) Prior Publication Data

US 2013/0249879 A1 Sep. 26, 2013

(51) Int. Cl.
*G09G 3/20* (2006.01)

(52) U.S. Cl.
USPC ..... 345/55; 345/212; 257/2; 257/5

(58) Field of Classification Search
USPC ..... 345/76, 77, 80, 84, 87, 92, 204, 205, 345/206, 55, 212; 257/5, E45.005, 192, 2; 365/148
See application file for complete search history.

(56) References Cited

U.S. PATENT DOCUMENTS

| | | | | |
|---|---|---|---|---|
| 3,906,537 | A | 9/1975 | Thornburg et al. | |
| 4,162,538 | A | 7/1979 | Thornburg | |
| 4,782,340 | A | 11/1988 | Czubatyj et al. | |
| 5,412,614 | A | 5/1995 | Bird | |
| 5,574,683 | A | 11/1996 | Mori | |
| 5,694,146 | A | 12/1997 | Ovshinsky et al. | |
| 5,757,349 | A * | 5/1998 | Togashi | 345/91 |
| 6,686,267 | B1 | 2/2004 | King | |
| 7,248,255 | B2 | 7/2007 | Yoshida | |
| 7,566,643 | B2 | 7/2009 | Czubatyi et al. | |
| 7,859,895 | B2 | 12/2010 | Lowrey | |
| 7,940,129 | B1 | 5/2011 | Tsang et al. | |
| 2002/0097829 | A1 * | 7/2002 | Kawahata | 377/57 |
| 2002/0158855 | A1 * | 10/2002 | Matsueda | 345/204 |
| 2006/0011942 | A1 * | 1/2006 | Kim et al. | 257/192 |
| 2008/0253167 | A1 | 10/2008 | Symanczyk | |
| 2009/0174651 | A1 | 7/2009 | Jacobson et al. | |
| 2009/0208639 | A1 * | 8/2009 | Yun et al. | 427/126.3 |
| 2010/0019996 | A1 * | 1/2010 | You et al. | 345/76 |
| 2010/0078620 | A1 * | 4/2010 | Xi et al. | 257/4 |
| 2010/0208507 | A1 | 8/2010 | Park et al. | |

FOREIGN PATENT DOCUMENTS

JP 08-008418 1/1996

OTHER PUBLICATIONS

Zhong, Z. et al; Nanowire Crossbar Arrays as Address Decoders for Integrated Nanosystems; http://www.sciencemag.org/content/302/5649/1377.abstract > On pp. 1377-1379; vol. 302; Issue: 5649; Nov. 21, 2003.

Shin, J. et al. ; Tio2-based Metal-insulator-metal Selection Device for Bipolar Resistive Random Access Memory Cross-point Application; http://ieeexplore.ieee.org/iel5/4915369/5709798/05710849.pdf?arnumber=5710849 > On pp. 033712-1-033712-4; vol. 109; Issue: 3; Feb. 2011.

* cited by examiner

*Primary Examiner* — Koosha Sharifi-Tafreshi
(74) *Attorney, Agent, or Firm* — Van Cott, Bagley, Cornwall & McCarthy; Steven L. Nichols

(57) ABSTRACT

A display matrix may have a resistance switch and a display element formed on a common display substrate. The resistance switch may have a metal insulator transition (MIT) material that has a negative differential resistance (NDR) characteristic that exhibits a discontinuous resistance.

19 Claims, 5 Drawing Sheets

DISPLAY MATRIX WITH RESISTANCE SWITCHES

BACKGROUND

Liquid crystal display panels are becoming increasingly popular. These panels generally involve activating pixels arranged in rows and columns. Thin film transistors are usually positioned adjacent and corresponding to the liquid crystals, which are opaque in an inactivated molecular form. The transistors are then selectively activated to change the appearance of the corresponding liquid crystal to form a desired image. In some commercial panels, the pixel density is extremely high, often involving thousands of rows and columns.

Generally, activating a pixel involves supplying both the pixel's row and column with electric signals that collectively interact with the thin film transistors to cause the generation of an electric field. This field influences the molecular structure of the adjacent liquid crystal in such a manner that permits light to pass through the liquid crystal. In some panels, a light source is positioned behind the liquid crystal and electrodes. Thus, the change in the liquid crystal's molecular structure allows light from this source to radiate through the liquid crystal. The selective activation of these pixels collectively forms an image on the panel's screen.

BRIEF DESCRIPTION OF THE DRAWINGS

The accompanying drawings illustrate various examples of the principles described herein and are a part of the specification. The illustrated examples are merely examples and do not limit the scope of the claims.

DETAILED DESCRIPTION

The present specification describes principles and illustrative applications of those principles including, for example, a display matrix with a resistance switch and a display element formed on a common display substrate. Examples of such a matrix may include that the resistance switch has a metal insulator transition (MIT) material that has a negative differential resistance (NDR) characteristic that exhibits a discontinuous resistance change at a threshold current.

The MIT material may have two independent stable resistance states or phases that correspond to whether the MIT material's internal temperature is above or below a transition temperature as will be discussed in detail below. One resistance phase is a metallic or conductive phase in which the MIT material exhibits a low resistance similar to metals, thus having a high conductivity. The other resistance phase is an insulator phase in which the MIT material exhibits a relatively high resistance similar to insulators.

Electrodes may be used to carry a current that heats the MIT material through the transition temperature to switch between resistance phases. So long as the current is flowing and the corresponding increase in temperature applied, the change in the resistance phase of the MIT material is stable.

In the following description, for purposes of explanation, numerous specific details are set forth in order to provide a thorough understanding of the present systems and methods. It will be apparent, however, to one skilled in the art that the present apparatus, systems, and methods may be practiced without these specific details. Reference in the specification to "an example" or similar language means that a particular feature, structure, or characteristic described is included in at least that one example, but not necessarily in other examples.

Figure 1:
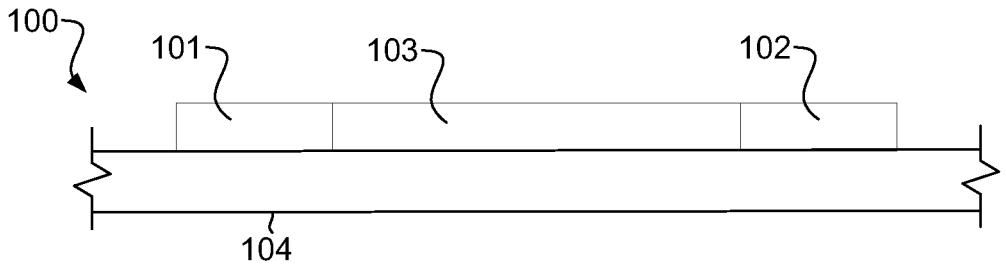
FIG. 1 is a diagram of an illustrative resistance switch, according to principles described herein.

FIG. 1 is a diagram of an illustrative resistance switch (100), according to principles described herein. The resistance switch (100) has a first electrode (101) separated from a second electrode (102) by the MIT material (103). The electrodes (101, 102) and the MIT material (103) may be formed on a transparent substrate (104) suitable for a display matrix, such as a large area substrate. In some examples, the resistance switch (100) is a two terminal device. In some examples, the resistance switch has a vertical structure, where a base electrode is formed directly on the substrate, the MIT material disposed over the base electrode, and the second electrode is formed over the MIT material layer.

The transparent substrate (104) may be made of glass, polymers, plastics, or combinations thereof. The substrate's material may be a material that is chemically inert with respect to a liquid crystal, plasma, organic material, or other optically alterable medium disposed adjacent the substrate, which will be described in more detail below. In some examples, the substrate and resistance switch (100) are flexible and may be rolled, bent, folded, or otherwise moved without compromising the resistance switch's structural integrity.

The substrate (104) may be a large area substrate that is large enough to include a display screen. For example, a substrate for a flat panel display screen may be over fifteen inches in height and twenty inches in width. In some examples, the screens are much larger. However, the substrate (104) may also be sized for screens that are smaller, such as screens on a digital camera, watch, or phone.

In some examples, the electrodes (101, 102) and MIT material (103) are made of transparent material such that, when a user views a display according to the principles described herein, the resistant elements are invisible. In some examples, the electrodes (101, 102) and the MIT material (103) are not transparent, but are small enough that they are still invisible to the unaided eye.

In some examples, the resistance switch is made of a series of deposited layers. For examples, a base electrode layer may be deposited directly on a surface of a large area substrate. The MIT material may be deposited directly to a surface of the deposited electrode layer. Finally, another electrode layer may be deposited over the MIT material. In such an example, the area of the large area substrate dedicated to the footprint of the resistance switch may be minimized, thus providing a contributing factor that allows the resistance switch to be invisible to the unaided eye.

Figure 2:
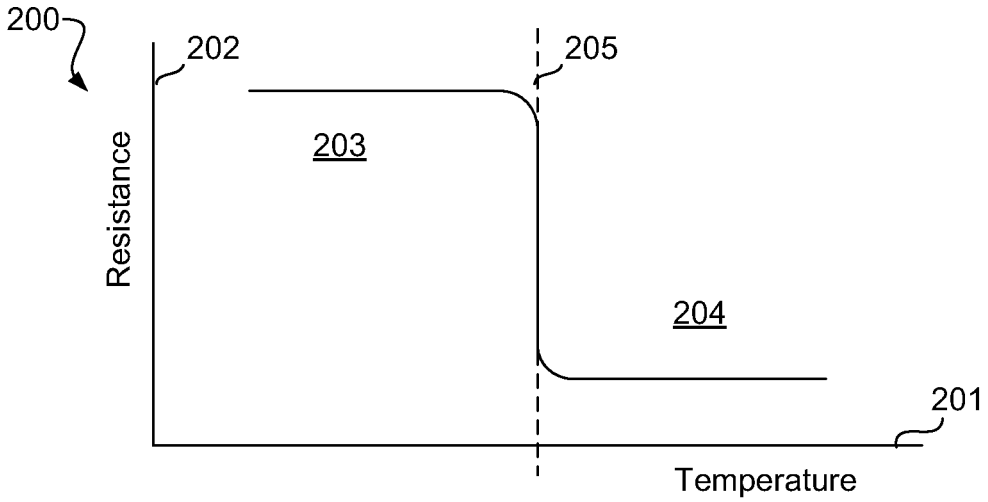
FIG. 2 is a diagram of a chart showing an illustrative thermal characteristic of a MIT material yielding NDR behavior, according to principles described herein.

The MIT material's thermal characteristic is exhibited by abrupt changes in its resistance as the material transitions between phases at a transition temperature. FIG. 2 illustrates a chart (200) showing an example of a thermal characteristic of a MIT material. The x-axis (201) represents temperature, and the y-axis (202) represents electrical resistance.

For low temperature, the MIT material of FIG. 2 exhibits high electrical resistance; therefore, the MIT material is in an insulator phase (203). However, for high temperatures, the MIT material of FIG. 2 exhibits low electrical resistance; therefore, the MIT material is in a metallic phase (204). In the example of FIG. 2, the MIT material switches phases at a transition temperature (205). During the insulator or high resistance phase, the amount of current passing through the MIT material may be restricted due to the high resistance. On the other hand, the amount of current passing through the MIT material during the metal or low resistance phase may be substantially greater due to the increased conductivity.

At the transition temperature (205) of FIG. 2, an abrupt transition takes place from one phase to another, and the resistance phases are generally stable. Vanadium, titanium, or niobium oxides or other transition metal oxides may result in abrupt resistance changes that may also exhibit NDR characteristics, and as such, may be a suitable MIT material.

Figure 3:
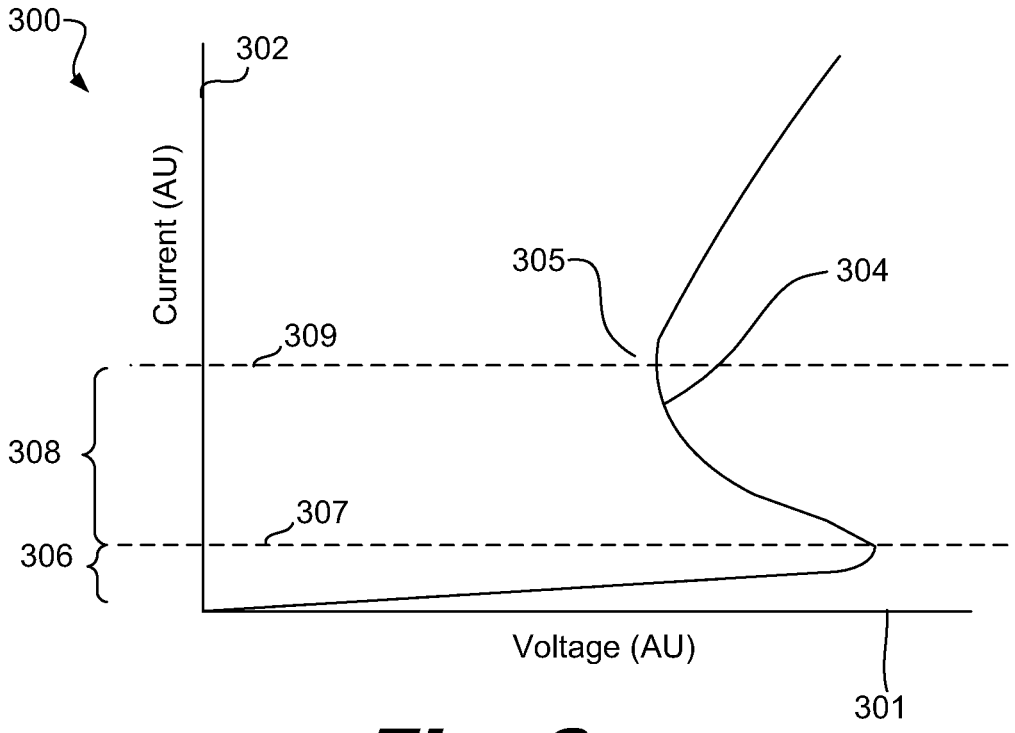
FIG. 3 is a diagram of a chart showing an illustrative NDR characteristic of a MIT material, according to principles described herein.

FIG. 3 illustrates an example of an NDR characteristic in an IV chart (300). The x-axis (301) schematically represents voltage in arbitrary units, and the y-axis (302) schematically represents current in arbitrary units. Current-voltage characteristics (304) include a low current range (306) where the differential resistance is positive. However, when the current reaches a threshold value which raises the internal temperature to the phase transition temperature (307), the voltage drops within a NDR current range (308). As the current increases, the current reaches another value (309), where the differential resistance is positive again.

Within the NDR region of the example of FIG. 3, the MIT material is undergoing a metal-to-insulator phase transition, but may exhibit either a metal or insulator phase. The MIT material may abruptly transition from one phase to the other phase by adjusting the current outside of the NDR regions, however, each phase may be stable, and the phase may be held at a current level within the NDR range. For example, an MIT material may need an initial high amount of current outside of the NDR range (308) causing the MIT material to transition to a metal phase abruptly. Once the phase transitions occurs, which in some examples occurs immediately, the current level may be dropped below the transition current (307) to maintain the MIT materials phase and as a consequence also maintain the activated condition of the display unit.

In some examples, the MIT material may exhibit an IV relationship when constant power is applied that approximates $I=(T_{MIT}-T_{amb})/V*\alpha$, where I is current, V is voltage, $T_{MIT}$ is a transition temperature where the MIT material transitions from a metal phase to an insulator phase, $T_{amb}$ is an ambient internal temperature, and $\alpha$ is the effective thermal resistance of the circuit.

A resistance switch in accordance with the principles described herein may be well suited for compact devices or applications where substrate space is valuable because the phase transition characteristics of the MIT material are bulk properties that may be independent of the physical sizes of its components. Thus, a resistance switch, made in accordance with the principles described herein, may have a reduced size and enable a smaller footprint for associated circuitry. As a consequence, in a matrix display where display elements share a common substrate with resistance switches, the resistance switch may have a small footprint, which may enable a display matrix to have a high pixel density. Further, due to the switch's simplicity, a resistance switch made in accordance with the principles described herein may endure extensive switching without fatigue and be relatively inexpensive to produce. Further, the MIT material may be compatible with a large range of transparent substrates.

In some examples, the MIT material may be a metal selected from a group consisting of niobium, titanium, tungsten, manganese, iron, vanadium, oxides thereof, nitrides thereof, doped alloys thereof, and combinations thereof. In some examples, the MIT material includes chromium doped vanadium oxide.

In some examples, the MIT material may expand as its internal temperature increase, which may open gaps. These gaps may interfere with the MIT material's electrical conductivity, thereby, increasing its electrical resistance. This volume characteristic may contribute, in part, to transitioning between metal and insulator phases.

In some examples, the transition characteristic of the MIT material is affected by how quickly the majority of the MIT material's volume transitions between phases. In some examples, the MIT material's volume may transition to another phase at an initial location and propagate from there. In alternative examples, the several discrete locations within the MIT material may independently transition to the other phase and propagate from each discrete location. Multiple initial phase transition locations may result in a quicker overall transition such that the MIT material thereby exhibits a more abrupt transition between phases.

Figure 4:
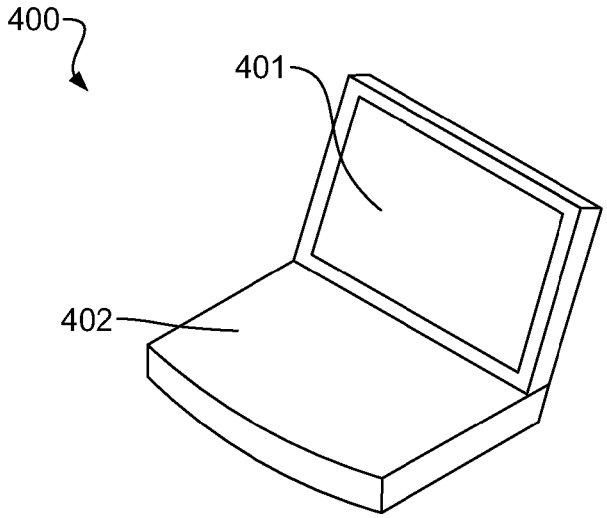
FIG. 4 is a diagram of an illustrative system, according to principles described herein.

FIG. 4 is a diagram of an illustrative system (400), according to principles described herein. The system (400) may have a display (401) and an input mechanism (402), such as a key pad. In some examples, the input mechanism may be incorporated into the display, such as a touch screen. The system (400) may incorporate a matrix with the resistance switches and display elements that will be described in more detail below.

The system (400) may be selected from the following non-exhaustive list of computers, monitors, phones, mobile devices, televisions, flat screen panels, laptops, electronic readers, clocks, global positioning devices, navigation devices, digital devices, personal digital assistants, tablets, gaming devices, timers, watches, medical imaging devices, screens, cameras, video cameras, instrument panels, calculators, and combinations thereof.

In some examples, the display (401) may include a reflector to reflect ambient light back through activated liquid crystals. In some examples, the display (401) includes a light source, such as a backlight, that provides light that passes through activated liquid crystals.

The display (401) may be a liquid crystal display, a light emitting diode display, an organic light emitting diode display, a plasma display, quantum dot display, or combinations thereof. In some examples, the display has an active or passive matrix.

Figure 5:
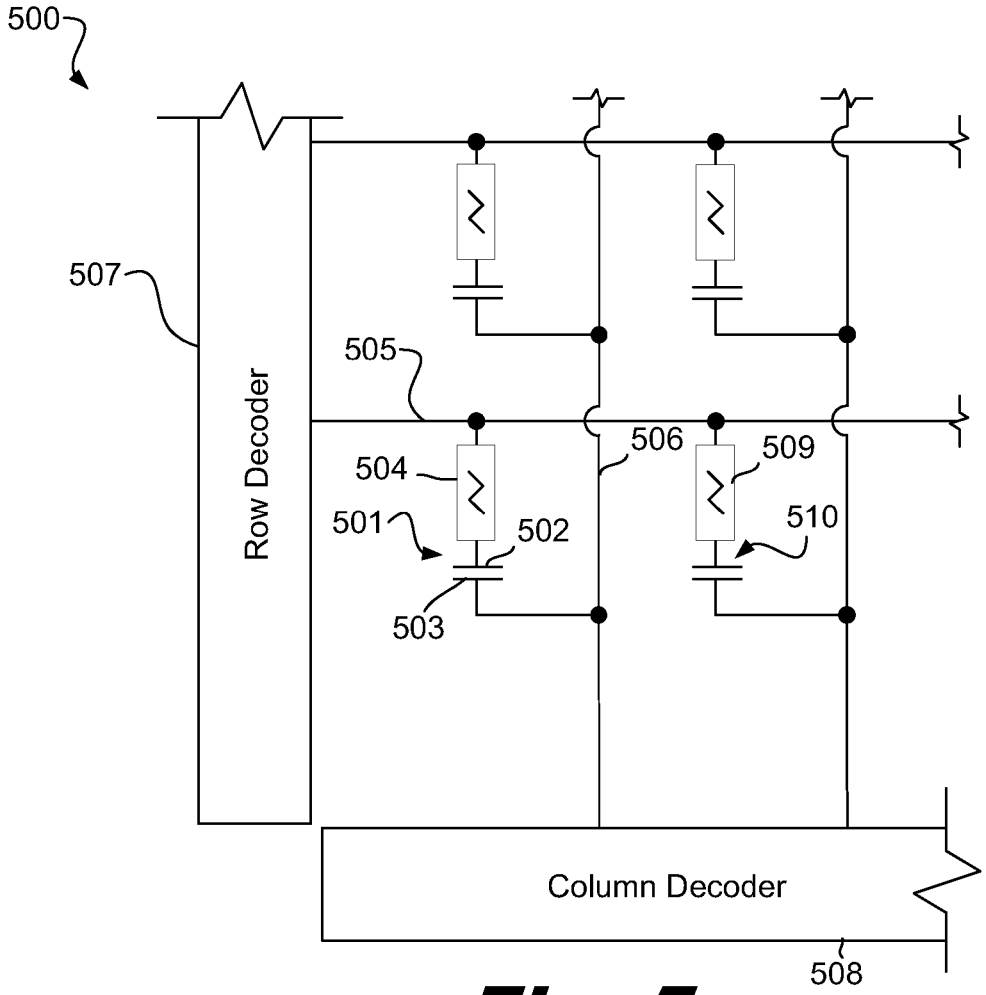
FIG. 5 is a diagram of an illustrative display matrix, according to principles described herein.

FIG. 5 is a diagram of an illustrative display matrix (500), according to principles described herein. In the example of FIG. 5, the matrix (500) has a plurality of display units, such as display unit (501). Display unit (501) has a row display element (502) and column display element (503) separated by a liquid crystal (not shown). The row element (502) is electrically connected in series to a resistance switch (504) with MIT material. The resistance switch (504) is electrically connected to a row conductor (505), and the column element (503) is electrically connected to a column conductor (506).

The row and column conductors (505, 506) are respectively electrically connected to row and column decoders (507, 508). The decoders have decoder circuitry to route an activation signal to the desired row or column.

In the example of FIG. 5, the row decoder (507), the row conductor (505), the resistance switch (504), and row display element (502) are supported on a first common transparent substrate, while the column decoder (508), the column conductor (506), and the column display element (503) are supported on a second common transparent substrate. The substrates may be oriented with respect to each other such that the row display element (502) and the column display element (503) are aligned with one another. A gap may exist between the first and second substrate, and a liquid crystal is disposed within the gap.

The row display element (502) and the column display element (503) may collectively exhibit capacitive characteristics when the row conductor (505) and the column conductor (506) are energized and the resistance switch (504) exhibits a low resistance phase. For example, when both the row display element (502) and the column display element (503) are energized, an electric field may be created between them. Since the liquid crystal is disposed between the row and column display elements (502, 503), the liquid crystal is subjected to the electric field.

The liquid crystal may have optical characteristics exhibited by changing its molecular orientation in the presence of an electric field such that the liquid crystal, which is normally opaque, changes its optical transparency to permit at least some light to pass through the liquid crystal. As a consequence, the display unit (501), in the presence of an electric field, may exhibit at least some level of optically transparency because light may pass through both the first and second transparent substrates and the liquid crystal. In this condition, the display unit may be considered activated for purposes of this description.

The row and column decoders (507, 508) may logically interpret input signals to collectively energize any display unit in the matrix by energizing the appropriate row and column conductors. For example, if the decoders (507, 508) receive inputs signals interpreted to activate the display unit (501), the column decoder (508) may impose a column voltage on a column conductor (506), and row decoder (507) may impose a row voltage on a row conductor (505).

The row and column voltages may be complementary voltages such that both voltages cause current to flow in the same direction at the same time, but collectively create a greater electromotive force to move the electric current. Thus, the overall voltage may be greater than either of the row voltage or the column voltage individually.

In the example of FIG. 5, the resistance switch (504) is connected in series to the row display element (502) and located between the row conductor (505) and the row display element (502). The resistance switch (504) may have a high resistance phase and a low resistance phase depending on the internal temperature of its MIT material. The row voltage may impose an electrical current on the MIT material that heats the MIT material through joule heating. However, in some examples, the row voltage may be insufficient to drive a current to heat the MIT material past the MIT material transition temperature to cause a phase transition to a low resistance phase. In such examples, the row voltage alone may be insufficient to allow enough current through the resistance switch (504) to energize the row display element. However, the overall voltage (the combination of the row and column voltages) may have enough power to heat the MIT material of the resistance switch (504) to transition the MIT material's phase to a low resistance phase and thereby permit sufficient current to reach the row display element. As a consequence of changing the resistance switch's phase, the row and column elements are energized to activate the display unit.

In such an example, the row conductor (505) may also provide a voltage to all of the resistance switches to which the row conductor is electrically connected, including resistance switch (509), which is serially connected to display unit (510). However, in the absence of a column voltage in column conductor (511), the current in the row conductor may not be sufficient on its own to transition the resistance switch's phase. Thus, the resistance switch (509) may isolate display element (510) from the row voltage. As a consequence, the display unit (510) may remain inactivated when the decoders (507, 508) output voltages to activate display unit (501). Thus, the resistance switch may be a display element driver positioned to prevent unwanted signals from activating display elements when the resistance switch's MIT material is in a high resistance phase.

While the display unit is described herein as having elements that generate an electric field, other examples of the display unit may include the creation of a magnetic field. In alternative examples, the display unit may include a diode, such as a light emitting diode or an organic light emitting diode. Further, in some examples, the display unit may include plasma, ions, gas, organic material, polymers, liquids, crystals, or combinations thereof as an optically alterable medium that may be disposed between the substrates for controlling the passage of light through the display unit.

A matrix (500) may utilize the MIT material's NDR characteristic to switch the phase of the resistance switches at lower power levels by energizing the row conductor (505) and the column conductor (506) with the appropriate combination of voltage or current. For example, the amount of current provided by the row conductor applied to the resistance switch may be outside of an NDR range where increases in the voltage are positively related to increases in the current, thus, the resistance switch's MIT material exhibits an insulator phase. However, adding the current provided by the column conductor may transition the MIT material to a metal phase while at the same time lowering the amount of voltage needed to maintain the higher amounts of currents. Since power is equal to the product of current multiplied by voltage, the overall power consumption to activate the display unit is lower.

Figure 6:
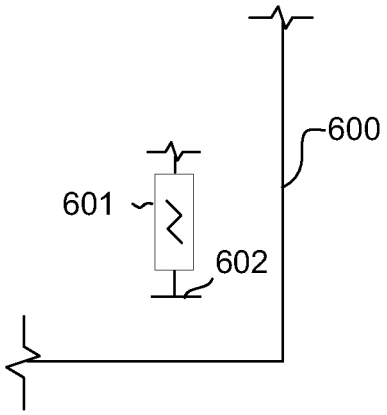
FIG. 6 is a diagram of illustrative display matrix components on an illustrative substrate, according to principles described herein.

FIG. 6 is a diagram of illustrative display matrix components on an illustrative substrate (600), according to principles described herein. In the example of FIG. 6, a resistance switch (601) and a display element (602) are disposed on a common transparent substrate (600). In some examples, the row decoder, row conductors, including row conductor, the resistance switches, including switches, and the row display elements, including row display elements, may be formed on a common transparent substrate. Further, the column decoder, column conductors, and column display elements may also be formed on a separate common substrate that is spaced apart from the substrate supporting the row components. An optically alterable medium, such as a liquid crystal, may be disposed within the space between the substrates.

Figure 7:
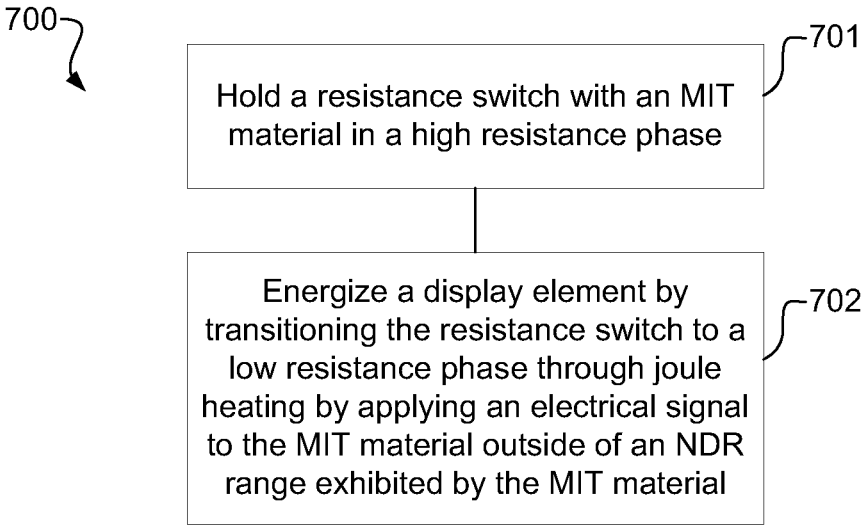
FIG. 7 is a diagram of an illustrative flowchart for controlling a display, according to principles described herein.

FIG. 7 is a diagram of an illustrative flowchart of a method (700) for controlling a display, according to principles described herein. In the example of FIG. 7, the method (700) includes holding (701) a resistance switch with MIT material in a high resistance phase and energizing (702) a display element electrically connected to the resistant element by transitioning the resistance switch to a low resistance phase through joule heating by applying an electrical signal to the MIT material outside of a NDR range exhibited by the MIT material.

The MIT material may have an NDR characteristic that results in the MIT material exhibiting discontinuous changes in resistance at specific temperatures achieved at threshold currents. The combination of the circuit's thermal characteristics and the MIT material's characteristics provide unique properties where a current change may drive the MIT material to transition between resistance phases. The combination of the resistance switch's thermal and NDR characteristics may lower the overall power needed to transition the resistance switch between phases thereby conserving energy when operating the matrix.

The resistance switch may be used in any location and for any function on a common substrate with a display element. For example, the resistance switch may be incorporated in either the row or column decoders.

Figure 8:
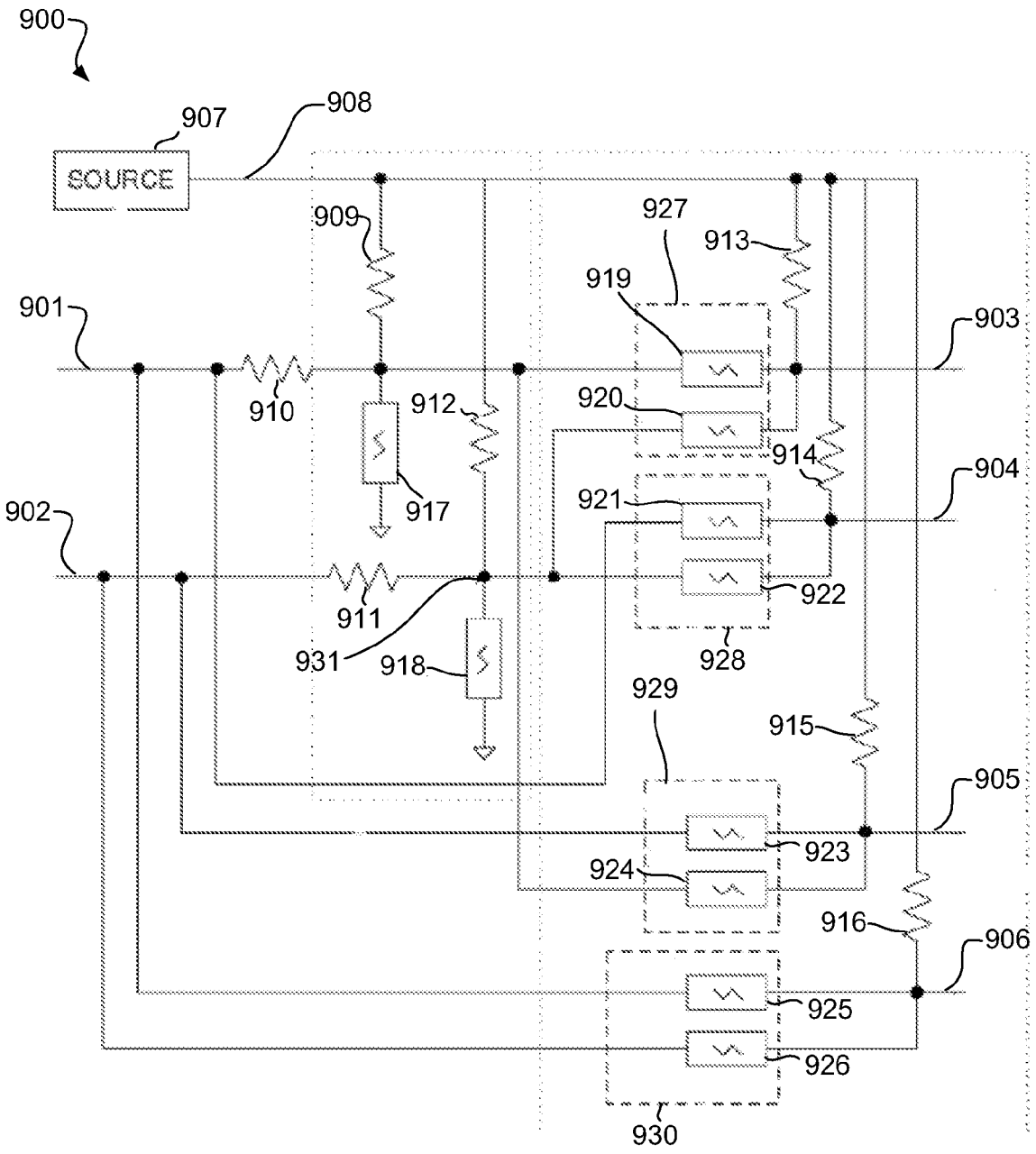
FIG. 8 is a diagram of an illustrative decoder circuit, according to principles described herein.

FIG. 8 is a diagram of an illustrative decoder circuit (900), according to principles described herein. In the example of FIG. 8, the decoder circuit includes a plurality of input lines (901, 902) and a plurality of output lines (903, 904, 905, 906). The input lines (901, 902) may receive signals encoding an address of a display unit within the matrix, and the output lines (903, 904, 905, 906) may electrically connect to the row and column conductors of the matrix.

The resistance switches may be coupled to the input lines (901, 902), a bias source (907), and the output lines (903, 904, 905, 906). The resistance switches may operate in their high or low resistance phases to guide addressable signals from the input lines to the proper output lines. In some examples, the decoder circuit is dedicated to decoding the output signals for row conductors while another decoder circuit is dedicated to the output signal for column conductors. These decoder circuits may be formed on a common large area substrate with the display elements and take advantage of the resistance switches' ability to be made small to minimize the footprint of the decoder circuits.

The phases of the resistance switches may be switched according to the digital logic of the decoder. Due to the NDR characteristics of the resistance switches, the power requirements per resistance switch may be kept low. Also, since the resistance switches' phases may be stable near the MIT material's internal transition temperature, a low margin change in voltage or current may be used to switch phases, which also contributes to power savings. These lower margins may also contribute to the decoder circuit operating at faster speeds.

The decoder circuit includes a bias line (908) connected to a plurality of resistors (909-916) and the resistance switches (917-926). The bias line (908) is electrically coupled to the bias source (907) to provide a biasing signal to bias the switches within the decoder circuit (900).

In some examples, the input lines (901, 902) may receive digital signals 0 and 1, respectively. The digital signals 0 and 1 may have a voltage of the bias source or a reference voltage. For purposes of clarity by example, the reference voltage is assumed to be electrical ground (0 volts). Assume the margin between the bias voltage and the reference voltage denotes a difference between logical low (0) and logical high (1). The signals 0 and 1 represent a two-bit input signal. The decoder circuit (900) directs these signals to the appropriate output in response to the input signals 0 and 1. The combination of logical low (0) and logical high (1) signals may correspond to an addressable display unit in the matrix. The decoders may use the following logic to direct signals to the appropriate display unit.

The plurality of resistors (909-916) implements bias logic to provide a signal bias, such as a voltage bias, to each of the resistance switches (917-926). In some examples, each of the resistors (909-916) and the switches (917-926) may be two-terminal devices.

Resistor (913) is coupled between the bias line (908) and first terminals of the switches (919) and (920), respectively. Resistor (910) is coupled between the input line (901) and a first terminal of the switch (917). Resistor (911) is coupled between the input line (902) and a first terminal of the switch (918). Resistor (914) is coupled between the bias line (908) and first terminals of the switches (921 and (922). The resistor (909) is coupled between the bias line (908) and the first terminal of the switch (917). Resistor (912) is coupled between the bias line (908) and the first terminal of the switch (918). Resistor (915) is coupled between the bias line (908) and first terminals of the switches (923 and 924), respectively. Resistor (916) is coupled between the bias line (908) and first terminals of the switches (925 and 926), respectively.

Second terminals of the switches (917 and 918) are respectively coupled to the reference voltage (e.g., ground). A second terminal of the switch (919) is coupled to the first terminal of the switch (917). A second terminal of the switch (920) is coupled to the first terminal of the switch (918). A second terminal of the switch (921) is coupled to the input line (901). A second terminal of the switch (922) is coupled to the first terminal of the switch (918). A second terminal of the switch (923) is coupled to the input line (902). A second terminal of the switch (924) is coupled to the first terminal of the switch (917). A second terminal of the switch (925) is coupled to the input line (901). A second terminal of the switch (926) is coupled to the input line (902).

In some examples, each of the switches (917-926) has a threshold voltage at which the internal temperature of the MIT material will transition phases. At this temperature, the resistance switches will exhibit their NDR characteristic by experiencing a decrease in voltage while at the same time experiencing a rise in current at certain current levels. This is opposed to standard electric devices that generally experience an increase in voltage with an increase in current. Due to the negative resistance, each of the switches (917-926) may experience a decrease in voltage with the rising current.

The resistance switches may be grouped into pairs to function as logical AND gates having two inputs and one output. For example, switches (919 and 920) may for pair (927), switches (921 and 922) may form pair (928), switches (923 and 924) may form pair (929), and switches (925 and 926) may form pair (930). The outputs of the switch pairs are respectively coupled to the output lines (903, 904, 905, 906). Switches (917 and 918) may each implement a logical inverter of the signals 1 and 0, respectively. Switch pair (927) receives logically inverted signals 0 and 1. The switch pair (928) receives signal 0 and logically inverted signal 1. The switch pair (929) receives logically inverted signal 0 and signal 1. The switch pair (930) receives signals 0 and 1.

The switch (918) provides logical inversion of the signal 1 as follows. Resistors (912 and 911) operate as a voltage divider at node (931), the output of which drives the switch (918). When the signal 1 is logical low (reference voltage), then voltage node (931) will be a fraction of the bias voltage determined by the values of the resistors (912 and 911). This new voltage will be referred to as Vdiv for the purposes of this description. For example, if resistors (912 and 911) are the same, than Vdiv will be half the bias voltage. Assume the threshold voltage of the switch (918) is above Vdiv and the reference voltage is ground (0 volts). If the signal 1 is logical low, the switch (918) may provide high resistance, thus, conducting a small amount of current, and the voltage at node (931) will effectively remain at Vdiv. As a consequence, a signal 1 that has the reference voltage is turned into a signal having the voltage Vdiv.

If the signal 1 is logical high, the voltage at node (931) will move towards the bias voltage until reaching the threshold voltage of the switch (918), after which the switch (918) will transition from a high resistance phase to a low resistance phase and conduct a larger amount of current. As the switch (918) conducts more current, the switch (918) will pull the voltage at node (931) towards the reference voltage to a voltage Vmin (e.g., in this example, Vmin is equal to the drop across the switch (918), Vdrop). By adjusting the values of resistors (912 and 911), and the threshold voltage of (918), the margin between Vdiv and Vmin can provide detectable difference between logic high and logic low. The resistors (910 and 909), and the switch (917), operate similarly with respect to the signal 0. The switches (918 and 917) represent a first stage of the decoder circuit 100 to logically invert the input signals 0 and 1.

The switches (919 and 920) provide a logical AND gate of inverted signals 0 and 1. Assume signals 0 and 1 are both logical low. As noted above, the logic low of the signals 0 and 1 will transition to Vdiv. The voltage across the switches (919 and 920) will reach the bias voltage−Vdiv. If the threshold voltage of the switches (919 and 920) is greater than bias voltage−Vdiv, then the switches (919 and 920) will provide high resistance and conduct a small current. Thus, the voltage on the output line (904) will be near the bias voltage. If either or both of the signals 0 or 1 are logical high, then the voltage across one or both of the switches (919 and 920) will approach the bias voltage−Vmin. Assuming the threshold voltage of the switches (919 and 920) is less than bias voltage−Vmin, then switch (919) and/or switch (920) will provide low resistance and conduct current. This will pull the voltage on the output line (903) to Vmin+Vdrop. Thus, the margin on the output line (903) is bias voltage−(Vmin+Vdrop). The switch pairs (928, 929, 930) operate similarly with respect to the switch pair (927). The switch pairs (927-930) represent a second stage of the decoder circuit (900) to receive the input signals 0 and 1 and logical inversions of the input signals 0 and 1.

The decoder circuit (900) has been described as having two input signals and four output signals. In general, the decoder circuit may have any number of inputs and outputs as needed to address each of the display units in the matrix. Also, the decoder circuit (900) may include a configuration of bias logic and resistance switches to form inverters and AND gates. It is to be understood that the bias logic and resistance switches can be implemented differently to form OR gates, NAND gates, NOR gates, XOR gates, other logical gates, or combinations thereof, to perform the overall function of decoding the input addresses.

The preceding description has been presented only to illustrate and describe examples of the principles described. This description is not intended to be exhaustive or to limit these principles to any precise form disclosed. Many modifications and variations are possible in light of the above teaching.

What is claimed is:

1. A display matrix, comprising:

a resistance switch and a display element formed on a common display substrate;

said resistance switch comprising a metal insulator transition (MIT) material; and said MIT material comprising a negative differential resistance (NDR) characteristic that exhibits a discontinuous resistance change at a threshold current that drives an internal temperature of said MIT material past a transition temperature;

wherein said resistance switch is a display element driver positioned to prevent a signal from activating said display element when said MIT material of said resistance switch is in a high resistance phase.

2. The matrix of claim 1, wherein said resistance switch and said display element are electrically connected in series.

3. The matrix of claim 1, wherein said resistance switch and said display element are electrically connected to a decoder circuit formed on said common display substrate.

4. The matrix of claim 1, wherein said resistance switch is electrically connected to a bias source.

5. The matrix of claim 1, wherein said resistance switch is part of a decoder circuit.

6. The matrix of claim 5, wherein said decoder circuit comprises at least one input and at least one output electrically coupled by said resistance switch.

7. The matrix of claim 6, wherein said resistance switch is part of a logic gate arranged to route a signal from said at least one input to said at least one output.

8. The matrix of claim 1, wherein said common display substrate comprises a transparent material selected from a group consisting of glass, plastics, polymers, and combinations thereof

9. The matrix of claim 1, wherein the MIT material comprises a metal selected from a group consisting of niobium, titanium, tungsten, manganese, iron, vanadium, oxides thereof, nitrides thereof, doped alloys thereof, and combinations thereof

10. A display device, comprising:

an active matrix comprising a resistance switch and a display element supported on a common display substrate;

said resistance switch comprising a metal insulator transition (MIT) material; and said MIT material comprising a negative differential resistance (NDR) characteristic that exhibits a discontinuous resistance change at a threshold current that drives an internal temperature of said MIT material past a transition temperature;

wherein said resistance switch is part of a decoder circuit and forms part of a logic gate that electrically connects an input to said display element to selectively activate said display element.

11. The display device of claim 10, wherein said resistance switch is a display element driver electrically connected to said display element in series.

12. The display device of claim 10, wherein said decoder circuit comprises a row decoder and a column decoder, said resistance switch and display element being connected at an intersection between a row line connecting to the row decoder and a column line connected to the column decoder, said row decoder to impose a voltage on said row line and said column decoder to impose a voltage on said column line.

13. A method of controlling a display matrix, comprising:

holding a resistance switch with a metal to insulator transition (MIT) material in a high resistance phase, said resistance switch being electrically connected to a display element formed on a common display substrate with said resistance switch; and energizing said display element by transitioning said resistance switch to a low resistance phase through joule heating by applying an electrical signal to said MIT material outside of a negative differential resistance (NDR) range exhibited by said MIT material.

14. The method of claim 13, wherein said NDR range is a current range.

15. The display device of claim 12, wherein said resistance switch and said display element are electrically connected in series.

16. The display device of claim 12, wherein said resistance switch is a display element driver positioned to prevent a signal from activating said display element when said MIT material of said resistance switch is in a high resistance phase.

17. The display device of claim 12, wherein said resistance switch is electrically connected to a bias source.

18. The method of claim 13, further comprising, with said resistance switch, preventing a signal from activating said display element when said MIT material of said resistance switch is in a high resistance phase.

19. The method of claim 13, further comprising, with said resistance switch, as part of a decoder circuit, selectively electrically connecting an input to said display element.

* * * * *

UNITED STATES PATENT AND TRADEMARK OFFICE

CERTIFICATE OF CORRECTION

PATENT NO. : 8,928,560 B2
APPLICATION NO. : 13/424776
DATED : January 6, 2015
INVENTOR(S) : Matthew D. Pickett et al.

It is certified that error appears in the above-identified patent and that said Letters Patent is hereby corrected as shown below:

In the Claims

In column 10, line 22, in Claim 8, delete "thereof" and insert -- thereof. --, therefor.

In column 10, line 27, in Claim 9, delete "thereof" and insert -- thereof. --, therefor.

Signed and Sealed this
Eleventh Day of August, 2015

Michelle K. Lee

Michelle K. Lee
*Director of the United States Patent and Trademark Office*